United States Patent [19]

Arai et al.

[11] Patent Number: 4,462,353

[45] Date of Patent: Jul. 31, 1984

[54] VARIABLE CYLINDER DEVICE FOR INTERNAL COMBUSTION ENGINES

[75] Inventors: Fuminao Arai, Chiryu; Hisashi Kodama, Nagoya; Yoshio Okabe, Kariya, all of Japan

[73] Assignee: Aisin Seiki Kabushiki Kaisha, Kariya, Japan

[21] Appl. No.: 482,445

[22] Filed: Apr. 6, 1983

[30] Foreign Application Priority Data

Apr. 15, 1982 [JP] Japan ..... 57-062693

[51] Int. Cl.[3] ..... F02D 13/06

[52] U.S. Cl. ..... 123/198 F; 123/90.16; 123/90.43

[58] Field of Search ..... 123/198 F, 90.16, 90.27, 123/90.43, 90.46

[56] References Cited

U.S. PATENT DOCUMENTS

| | | | |
|---|---|---|---|
| 3,786,792 | 1/1974 | Pelizzoni et al. | 123/90.16 |
| 3,964,455 | 6/1976 | Brown | 123/90.43 |
| 4,114,588 | 9/1978 | Jordan | 123/198 F |
| 4,169,449 | 10/1979 | Brock, Jr. | 123/198 F |
| 4,173,209 | 11/1979 | Jordan | 123/198 F |
| 4,175,534 | 11/1979 | Jordan | 123/198 F |
| 4,258,671 | 3/1981 | Takizawa et al. | 123/90.16 |

*Primary Examiner*—Ira S. Lazarus

*Attorney, Agent, or Firm*—Oblon, Fisher, Spivak, McClelland & Maier

[57] ABSTRACT

A variable cylinder device for internal combustion engines comprising a adjuster coupled to a rocker arm of an intake or exhaust valve lift mechanism so as to define a first rocking point of said rocker arm, the lash adjuster having a check ball which is pushed by the operation of a solenoid valve when the engine load is reduced to a small order, as the result of which the rocking point of the rocking arm shifts from the first rocking point to a second rocking point wherein the intake or exhaust valve maintains the closed position.

2 Claims, 1 Drawing Figure

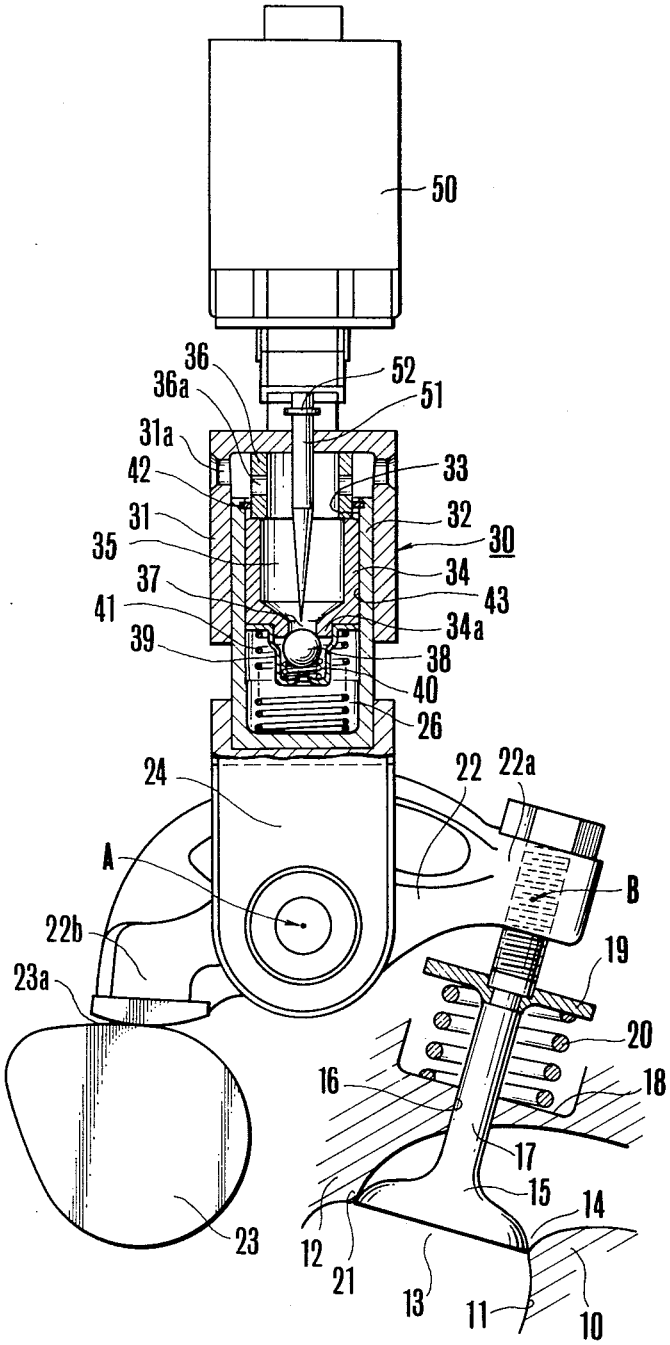
50
36
36a
52
51
31a
42
33
31
32
35
30
37
34
41
43
34a
39
38
40
26
24
22
22a
A
B
22b
19
23a
20
16
18
17
15
14
23
12
21
13
11
10

VARIABLE CYLINDER DEVICE FOR INTERNAL COMBUSTION ENGINES

BACKGROUND OF THE INVENTION

1. Field of the Invention

This invention relates to a variable cylinder device for internal combustion engines and more particularly to a variable cylinder device for internal combustion engines which has a valve lift mechanism to which a lash adjuster of oil-supplying type is fitted.

2. Prior Art of the Invention

In recent years, variable cylinder devices for internal combustion engines employing a number of different methods which have as their objective the conservation of energy and the reduction of fuel consumption of the vehicle have been made available. Generally, in such devices, the number of cylinders that are operating is controlled in accordance with the load that the engine is called on to handle; for example, when the load is small, the number of cylinders is reduced so as to achieve reduced fuel consumption.

However, the variable cylinder devices that have been developed thus far—such as, for example, those that cut back on the fuel injected into the engine from the carburator in accordance with input signals from the engines—have a defect consisting of the fact that it is not possible to achieve really large and significant reductions in fuel consumption since opening and closing of intake and exhaust valves continue to take place. It is true that systems have been proposed that formulate a lash or clearance in the valve train to stop the opening and closing function of the intake and exhaust valves. However, in this method, there still remain such problems as the fact that outstanding durability in terms of physical strength is called for in the device in order to create the clearance required, or the fact that there is a strong requirement for a high degree of reliability in the functioning of the system.

SUMMARY OF THE INVENTION

It is, therefore, an object of the present invention to provide a new and improved variable cylinder device for internal combustion engines which obviates the above mentioned various prior drawbacks.

It is another object of the present invention to provide a new and improved variable cylinder device for internal combustion engines which achieves the significant reduction in fuel consumption.

It is still another object of the present invention to provide a new and improved variable cylinder device for internal combustion engines which is high in durability.

According to the present invention, a variable cylinder device for internal combustion engines comprising:

a valve lift mechanism having a rocker arm which causes an intake or exhaust valves to operate in response to a rotary movement of a cam-shaft, a lash adjuster of oil-supplying type connected to said valve lift mechanism and coupled to said rocker arm so as to define a first rocking point of said rocker arm, said lash adjuster including a plunger slidably disposed within an adjuster body so as to define a reservoir and a pressure chamber, and a check ball positioned between said reservoir and said pressure chamber to allow only the flow of fluid from said reservoir into said pressure chamber, said rocker arm having one end which is brought in contact with a cam-surface of said cam-shaft and the other end which is securely connected to a valve stem of said intake or exhaust valve to thereby define the second rocking point, and a solenoid valve having a valve stem which is actuated in accordance with input signals from the engine to thereby push said check valve into a position wherein a passage between said reservoir and said pressure chamber is opened, whereby the rocking point of said rocker arm is shifted from the first rocking point to the second rocking point so as to maintain the closed position of said intake or exhaust valve.

BRIEF DESCRIPTION OF THE DRAWING

Other objects and their attendant advantages will become apparent as the following detailed description is read in conjunction with the accompanying drawing wherein:

The single drawing is a partial cross sectional view showing a valve lifting mechanism of an internal combustion engine fitted with a variable cylinder device according to the present invention.

PREFERRED EMBODIMENT OF THE INVENTION

In the drawing, a piston (not shown) carries out reciprocal up and down movements inside a cylinder 11 that is formed in a cylinder block 10. A combustion chamber 13 is formed above the piston by means of a cylinder head 12 at the upper end part of the cylinder 11. Opening and closing of the passage between the combustion chamber 13 and a cylinder head port 14 is controlled by means of an intake or exhaust valve 15. A valve stem 17 is inserted in a movable manner in a valve guide 16 formed in the cylinder head 12. Fitted between a spring seat 18 formed at the upper end section of the cylinder 12 and a spring retainer 19 is a valve spring 20 in a state of tension. The valve 15 is constantly biased upwardly so that the valve 15 is normally seated against a valve seat 21. One end **22*a* of a rocker arm 22 is securely linked to the uppermost part of the valve stem 17, while the other end 22*b* thereof is brought in contact with a cam surface 23*a* of a cam-shaft 23**.

The rocker arm 22 is secured to a rocker supporter 24, but is capable of rocking around point A of the supporter 24 as its pivot point. The rocker arm 22 carries out a rocking movement in response to the rotary movement of the cam-shaft 23, as a result of which the valve 15 repeats its opening and closing function.

A lower section of a lash adjuster 30 of oil-supplying type which is well known is inserted and secured in the center hollow section of the rocker supporters 24. Meanwhile, the upper part of the adjuster 30 is inserted in a slidable manner in the center hollow section of an adjuster supporter 31. An adjuster body 32 has an inside cylinder 33 whose upper end is open, and a plunger 34 carries out a reciprocating movement in the up-and-down direction inside the cylinder 33. A reservoir 35 is formed inside the plunger 34, and, for example, oil that is sent under pressure from the oil pump is supplied into the reservior 35. The supplying of the oil is carried out through passages **31*a* and 36*b* formed in the adjuster support 31 and a plunger support 36**, respectively.

At the lower part of the interior of cylinder 33, a pressure chamber 26 is formed by means of the lower surface of the plunger 34. Formed at a center of a lowermost section **34*a* of the plunger 34 is an oil passage 37, and a ball check valve 38 is positioned on the pressure chamber 36 side of the passage 37. This check valve 38 permits the flow of oil from the reservoir 35 to the pressure chamber 26, but prevents a reverse flow of the oil from the pressure chamber 26 to the reservoir 35. The check valve 38 is ordinarily biased towards the closed direction by means of one end of a spring 40 whose other end is seated against a retainer 39. The pressure chamber 26 has a plunger spring 41, therein, the biasing force of which is stronger than that of the spring 40, and therefore the plunger 34 is ordinarily pressed upwards in relation to the adjuster body 32 by means of this spring 41. A snap ring 42 is press-fitted at the upper inner circumference of the adjuster body 32 and serves to restrict any upward shifting of the plunger 34. A clearance 43 formed between the inner circumference surface of the adjuster body 32 and the outer circumference surface of the plunger 34 defines a passage for leakage oil from the pressure chamber 26**.

A solenoid valve 50 fitted to the upper section of the adjuster body 31 is activated by a microcomputer (not shown). The microcomputer senses the input signals from the engine such as, for example, the speed of the vehicle, the degree of throttle opening, and the temperature of the engine, to regulate and activate valve 50. A valve stem 51 of the solenoid valve 50 penetrates through the center of the upper surface 31*a* of the adjuster supporter 31 and extends to the interior of the reservoir 35, and is slidable in the up and down direction. The valve stem 51 shifts downwards in accordance with the operation of the solenoid valve 50, and when the aforementioned check valve 38 is pressed downwards, oil passage 37 opens, and part of the oil in the pressure chamber 26 moves into the reservoir 35. A ring form stopper 52 is fitted to the upper part of the valve stem 51, so that, when the valve stem 51 moves downwards and the stopper 52 comes into contact with the upper end surface of the adjuster supporter, the further downward movement of the valve stem 51 is restricted.

Next the operation of this device as described above will be explained. Ordinarily, while the engine is in operation, the aforementioned lash adjuster 30 is repeating an expanding-contracting movement of a small order (normally 2 mm–3 mm), and absorbs any clearance that has come into being in the valve lift mechanism or any heat expansion, and thus functions so that the valve mechanism is always maintained at a constant dimension. Detailed explanations of this normal operation will not be discussed here.

When the engine load is small, the microcomputer will sense, for example, engine input signals such as engine vacuum, vehicle speed, and degree of throttle opening, to activate solenoid valve 50. In response to the operation of solenoid valve 50, the valve stem 51 moves downwards, presses the check valve 38 downwards, and opens the oil passage 37. The valve stem 51 slides down until the stopper 52 comes into contact with the upper end surface 31*a* of the adjuster supporter 31. At this time, the two chambers consisting of the pressure chamber 26 and reservoir 35 will be connected to each other, and oil in the pressure chamber 26 will be able to shift into the reservoir 35; and so when the cam surface 23*a* carries out its rotary movement, the adjuster body 32 of the lash adjuster 30 will shift in the upper direction relative to the adjuster supporter 31. That is to say, the rigidity of the lash adjuster 30 will be eliminated. Therefore, the rocker arm 22 will carry out a rocking motion repeatedly, in response to the rotary movement of the cam surface 23*a*, around the linkage section B of the valve stem 17 of the arm 22 serving as its pivot. As a result, even when the cam surface 23*a* comes to the uppermost position, the rocker arm will carry out a turning movement around point B as its pivot, and so the valve lift mechanism will come to a stop and the opening and closing operations of the valve 15 will be stopped. Namely, the valve 15 is maintained in a closed position. The amount of shift of the adjuster body 32 relative to the adjuster supporter 31 is designed taking into consideration the amount of the stroke of the intake or exhaust valve 15.

While a preferred embodiment of the invention has been described, it will be readily apparent to those skilled in the art that various changes and arrangements can be made to accomplish the objects of the invention without departing from the scope and spirit of the appended claims.

What is claimed is:

1. A variable cylinder device for internal combustion engines comprising:

a valve lift mechanism having a rocker arm which causes an intake or exhaust valves to operate in response to a rotary movement of a cam-shaft, a lash adjuster of oil-supplying type connected to said valve lift mechanism and coupled to said rocker arm so as to define a first rocking point of said rocker arm, said lash adjuster including a plunger slidably disposed within an adjuster body so as to define a reservoir and a pressure chamber, and a check ball positioned between said reservoir and said pressure chamber to allow only the flow of fluid from said reservoir into said pressure chamber, said rocker arm having one end which is brought in contact with a cam-surface of said cam-shaft and the other end which is securely connected to a valve stem of said intake or exhaust valve to thereby define the second rocking point, and a solenoid valve having a valve stem which is actuated in accordance with input signals from the engine to thereby push said check valve into a position wherein a passage between said reservoir and said pressure chamber is opened, whereby the rocking point of said rocker arm is shifted from the first rocking point to the second rocking point so as to maintain the closed position of said intake or exhaust valve.

2. A variable cylinder device for internal combustion engines as set forth in claim 1, further comprising a rocker arm supporter secured to said rocker arm at the approximately center of said rocker arm to define said first rocking point and having a center hollow section which securely receives the lower section of said lash adjuster.

* * * * *